US005544608A

United States Patent [19]

Horton, III

[11] Patent Number: 5,544,608

[45] Date of Patent: Aug. 13, 1996

[54] METHOD OF INSTALLING OR RETRIEVING MOORING LINES INDEEP WATER

[75] Inventor: Edward E. Horton, III, Rancho Palos Verdes, Calif.

[73] Assignee: Deep Oil Technology, Inc., Irvine, Calif.

[21] Appl. No.: 564,838

[22] Filed: Nov. 29, 1995

[51] Int. Cl.[6] ..... B63B 21/00

[52] U.S. Cl. ..... 114/230; 114/293

[58] Field of Search ..... 114/230, 244, 114/253, 254, 293, 294; 405/154, 158, 170

[56] References Cited

U.S. PATENT DOCUMENTS

| | | | |
|---|---|---|---|
| 3,965,842 | 6/1976 | Cailloux | 114/244 |
| 4,020,779 | 5/1977 | Kitt | 114/293 |
| 4,072,123 | 2/1978 | Byers | 114/254 |
| 4,130,077 | 12/1978 | Person et al. | 114/230 |
| 4,446,807 | 5/1984 | Johnson et al. | 114/293 |

*Primary Examiner*—Stephen Avila

*Attorney, Agent, or Firm*—Robert J. Edwards; D. Neil LaHaye

[57] ABSTRACT

A method of setting out long mooring lines that includes the use of both a traction, or drum, winch and a linear winch. An anchoring vessel is provided with supply drums that contain the mooring line, a traction winch, and a linear winch. When the mooring line is lowered or retrieved, the traction winch, is used to maintain tension on the line until a connector approaches the traction winch. The linear winch is then engaged to maintain tension on the line, with the traction winch under low tension, until the connector passes through the linear winch. The traction winch is then reengaged to maintain all the tension on the line and the linear winch is disengaged until the next connector approaches the traction winch.

1 Claim, 2 Drawing Sheets

METHOD OF INSTALLING OR RETRIEVING MOORING LINES INDEEP WATER

BACKGROUND OF THE INVENTION

1. Field of the Invention

The invention is generally related to the mooring of floating offshore structures and more particularly to a method of setting mooring lines for floating offshore structures in deep water.

2. General Background

In the offshore drilling industry, floating structures such as tension leg platforms and deep draft floating caissons are being used in five thousand feet of water and deeper. Such structures are held in position by a plurality of mooring lines that each have one end attached to the floating structure and the opposite end attached to anchors or pilings embedded in the sea floor and spaced laterally from the floating structure. The length of each mooring line between the floating structure and the anchor may be twenty thousand feet or more, with the mooring line having a diameter of four to five inches. Since such lines are not normally manufactured in such lengths, connectors must be used to attach several lines together. These connectors are a larger diameter than the line and are not flexible. As a result, a traction or drum winch is unable to maintain tension on the line without damaging the connectors. The use of a linear winch alone, which uses coaxially aligned grippers that open and close in an alternating fashion to allow the passage of these connectors present the problem of being much slower than traction winches. This presents a need for a time saving means of setting out long mooring lines having connectors that can not be passed around a traction winch while maintaining tension on the line.

SUMMARY OF THE INVENTION

The invention addresses the above need. What is provided is a method of installing or retrieving long mooring lines that includes the use of both a traction, or drum, winch and a linear winch. An anchoring vessel is provided with supply drums that store the mooring line, a traction winch, and a linear winch. When the mooring line is lowered or retrieved, the traction winch, is used to maintain tension on the line until a connector approaches the traction winch. The linear winch is then engaged to maintain tension on the line, with the traction winch under low tension, until the connector passes through the linear winch. The traction winch is then reengaged to maintain all the tension on the line and the linear winch is disengaged until the next connector approaches the traction winch.

BRIEF DESCRIPTION OF THE DRAWINGS

For a further understanding of the nature and objects of the present invention reference should be had to the following description, taken in conjunction with the accompanying drawing in which like parts are given like reference numerals, and wherein.

DETAILED DESCRIPTION OF THE PREFERRED EMBODIMENT

Figure 1:
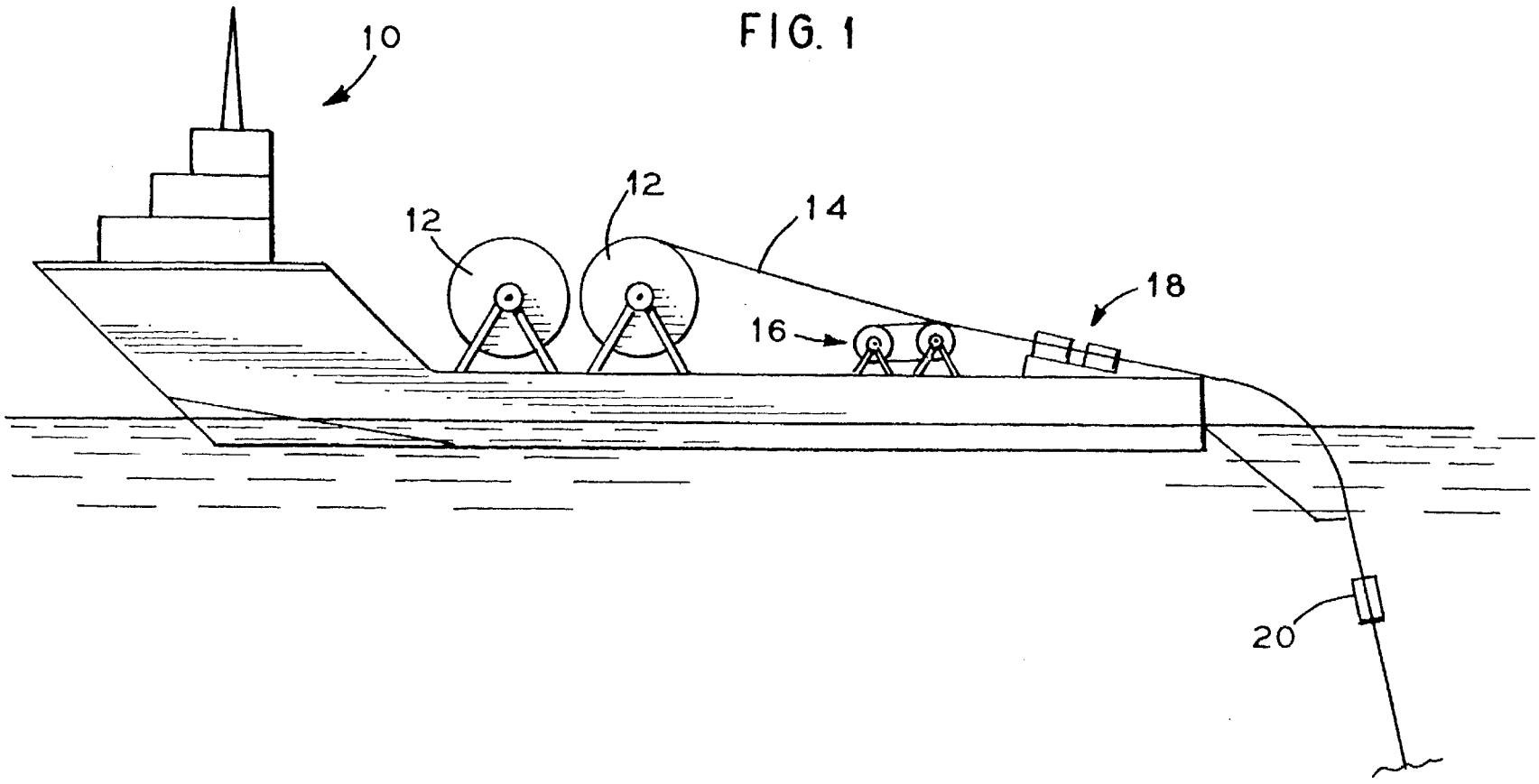
FIG. 1 is an elevation view that illustrates a vessel with which the invention may be carried out.
Figure 2:
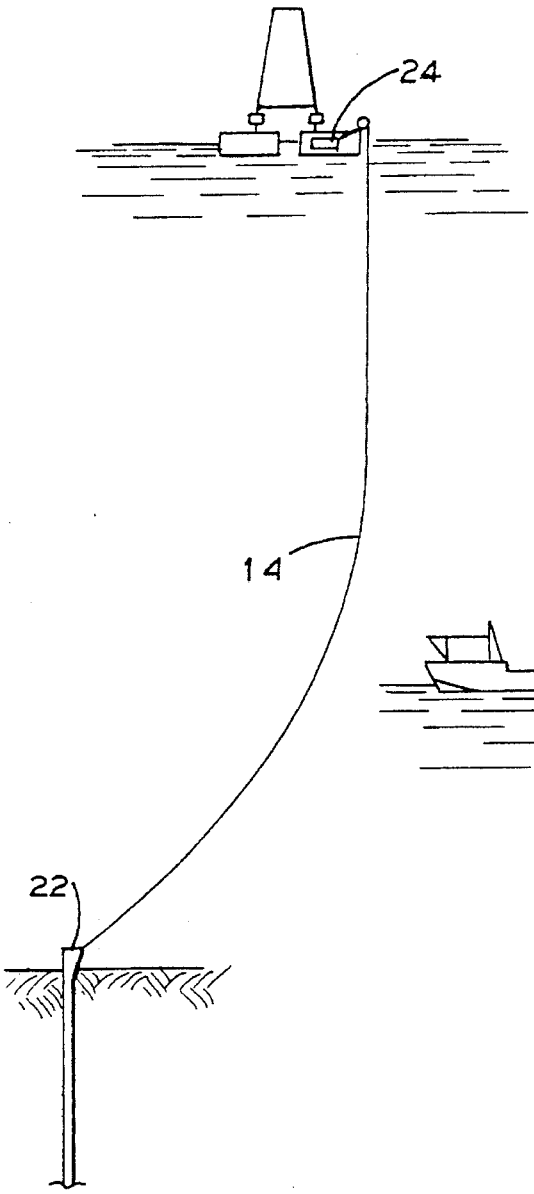
FIG. 2 illustrates a mooring line attached to an anchor and floating buoy.
Figure 3:
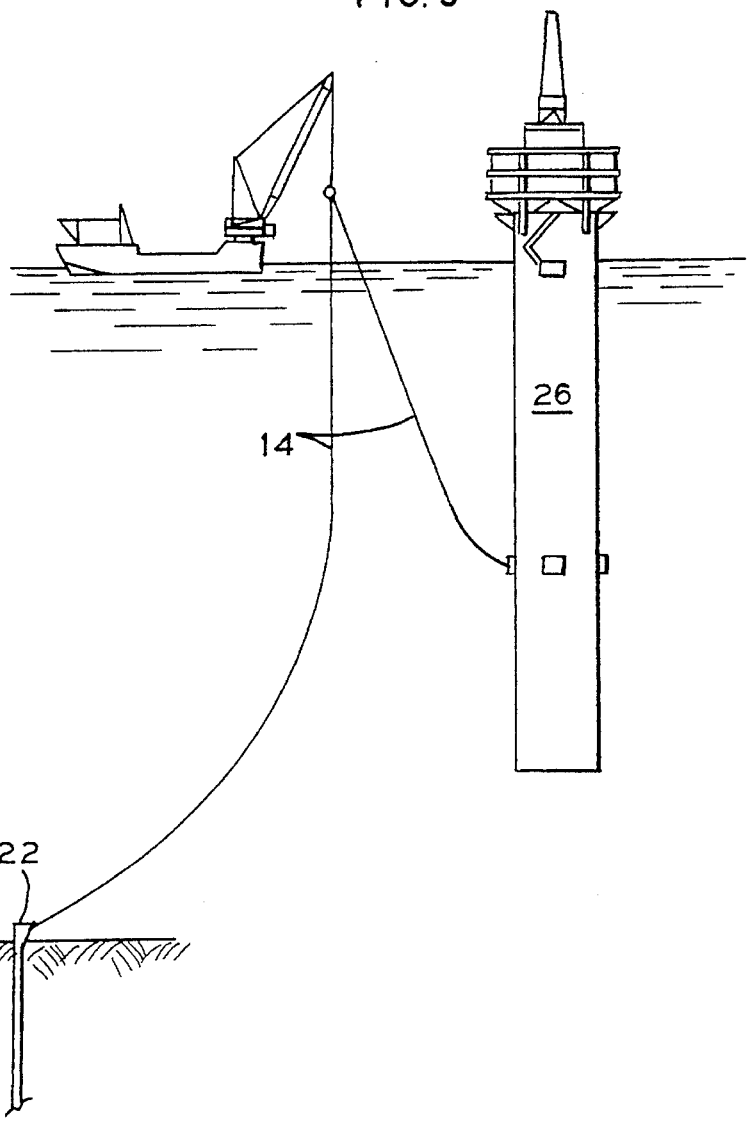
FIG. 3 illustrates a mooring line being attached to a floating structure.

FIG. 1 illustrates an anchoring vessel 10 that is provided with supply drums 12 that store the mooring line 14, a traction winch 16, and a linear winch 18. When installing or removing mooring lines 14, the connector 20 that connects two different lengths of line together has a diameter that is larger than the line 14. Thus, the connector 20 may not be passed around the drums of traction winch 16 with the traction winch handling all of the tension on the line 14 without causing damage to either the connector 20, the traction winch 16, or both. Thus, the process for installing a mooring line 14 will be carried out as follows. The end of the mooring line 14 is run through the traction winch 16 and linear winch 18 and off the end of the anchoring vessel 10. The end of the mooring line is then lowered to a preinstalled anchor 22, seen in FIG. 2, on the sea floor where the line 14 is attached to the anchor 22. As a connector 20 on the line 14 approaches the traction winch 16, the linear winch 18 is engaged to transfer tension on the line 14 from the traction winch 16 to the linear winch 18 so that the connector 20 passes through the traction winch 16 without damage to the line or traction winch. After the connector 20 has passed through the traction winch 16, the traction winch 16 is reengaged to full tension and the linear winch 28 is disengaged to transfer tension back to the traction winch 16. The traction winch 16 is capable of operating at a more rapid rate than the linear winch 18. Therefore, using the linear winch 18 only during over boarding of the connector 20 allows the line 14 to be paid out faster than if the linear winch 18 is used for the entire procedure. When the correct amount of line 14 has been paid out, the end may then be attached to a spring buoy 24 as seen in FIG. 2 for later attachment to the floating structure as seen in FIG. 3 or it may be immediately attached to the floating structure 26 if the floating structure 26 is already in position. The same winch procedure is used on the anchoring vessel 10 when the mooring line 14 is being retrieved.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A method for setting out or retrieving a mooring line, comprising:

a. providing a vessel having a supply drum containing a length of mooring line that has one or more connectors alone the length of the line, a traction winch, and a linear winch;

b. utilizing the traction winch to maintain tension on the mooring line during paying out or retrieving of the mooring line until a connector on the mooring line nears the traction winch;

c. engaging the linear winch with the mooring line and transferring tension from the traction winch to the linear winch;

d. paying out or retrieving the mooring line utilizing the linear winch until the connector on the mooring line has passed through the traction winch; and e. disengaging the linear winch from the mooring line while reengaging the traction with the mooring line to transfer tension on the mooring line to the traction winch.

* * * * *